US007107750B2

(12) United States Patent
Thiriot

(10) Patent No.: US 7,107,750 B2
(45) Date of Patent: Sep. 19, 2006

(54) COMPOSITE YARN

(75) Inventor: Laurent Thiriot, Andolsheim (FR)

(73) Assignee: Kermel, Colmar (FR)

( * ) Notice: Subject to any disclaimer, the term of this patent is extended or adjusted under 35 U.S.C. 154(b) by 109 days.

(21) Appl. No.: 10/481,843

(22) PCT Filed: Jun. 27, 2002

(86) PCT No.: PCT/FR02/02232

§ 371 (c)(1),
(2), (4) Date: Jan. 26, 2004

(87) PCT Pub. No.: WO03/002797

PCT Pub. Date: Jan. 9, 2003

(65) Prior Publication Data

US 2004/0216443 A1 Nov. 4, 2004

(30) Foreign Application Priority Data

Jun. 28, 2001 (FR) ..... 01 08526

(51) Int. Cl.
*D02G 3/02* (2006.01)

(52) U.S. Cl. ..... 57/210

(58) Field of Classification Search ..... 57/224
See application file for complete search history.

(56) References Cited

U.S. PATENT DOCUMENTS

| | | | | |
|---|---|---|---|---|
| 4,331,729 | A * | 5/1982 | Weber | 442/191 |
| 4,958,485 | A * | 9/1990 | Montgomery et al. | 57/210 |
| 5,033,262 | A | 7/1991 | Montgomery et al. | |
| 6,606,846 | B1 * | 8/2003 | Land | 57/5 |
| 6,723,265 | B1 * | 4/2004 | Osaka et al. | 264/103 |
| 2004/0035489 | A1 * | 2/2004 | Thiriot | 139/420 R |
| 2005/0055997 | A1 * | 3/2005 | Bader | 57/224 |

FOREIGN PATENT DOCUMENTS

| | | |
|---|---|---|
| EP | 0 885 936 A | 12/1998 |
| FR | 2 792 011 A | 10/2000 |

* cited by examiner

*Primary Examiner*—Shaun R. Hurley
(74) *Attorney, Agent, or Firm*—Weingarten, Schurgin, Gagnebin & Lebovici LLP

(57) ABSTRACT

The invention relates to composite yarn of bright color. It is obtained from yarn or fibers of at least two types, yarn or fibers of bright color and temperature-stable and/or smothering yarn or fibers. The yarn and the textile articles obtained from said yarn provide excellent protection against heat and/or flame.

11 Claims, No Drawings

COMPOSITE YARN

This application is a 371 national phase filing of PCT/FR02/02232 filed Jun. 27, 2002, and claims priority to a French application No. 01/08526 filed Jun. 28, 2001.

The present invention relates to the field of composite yarn of bright color, and in particular composite yarn of high visibility. It relates more particularly to a composite yarn suitable for use in making clothes of bright color or high visibility, and also for providing good protection against heat and/or flame.

BACKGROUND OF THE INVENTION

In certain fields of industry, workers can be exposed to heat and to flame. They therefore need to wear protective clothing made from specially adapted textile yarn. Protective clothing is the subject of standards designed to guarantee a protection threshold. Particular mention can be made of the standard EN 531.

On another topic, it is sometimes required that clothes be bright in color in order to present great visibility, so as to give warning that workers are present. Thus, yarn is available in the following colors: royal blue, fluorescent yellow, fluorescent orange, fluorescent red. Using clothes of different colors can serve as a distinctive sign, making it possible, for example, to distinguish between a plurality of teams on a worksite or a zone where action is being taken. Bright colors for workers' clothing vary over a wide range of shades.

Thus, for example, yarn of royal blue color is known which enables a good level of visibility to be obtained. Yarn is also known of yellow color, of orange color, and of red color that enable a level of visibility to be obtained that satisfies visibility criteria such as those defined in standard EN 471, for example.

In several sectors of activity, it is necessary for workers to wear clothing that simultaneously provides protection against the risks associated with fire and that is also bright in color, and in particular highly visible. For this purpose, brightly colored yarn, in particular yellow yarn, is known that satisfies the criteria of high visibility and protection against fire. The yarn is intrinsically resistant to heat and it contains yellow pigments.

That solution is not suitable, for example, for obtaining yarn of high visibility orange color satisfying the criteria of standard EN 471 and also providing protection against heat. No yarn of fluorescence orange color is known that confers satisfactory fire protection.

OBJECTS AND SUMMARY OF THE INVENTION

An object of the present invention is to propose a solution to this problem by presenting novel textile yarn of bright color, and particularly of high visibility, that also provides protection against the risks associated with fire, and in particular novel textile yarn that is orange.

To this end, the invention provides a composite yarn of bright color comprising a core surrounded by a casing, the yarn being characterized in that it comprises at least:

yarn or fibers A of bright color;

at least one type of yarn or fibers selected from the following group:

temperature-stable yarn or fibers B; and smothering yarn or fibers C causing gas to be given off of a kind to inhibit combustion of adjacent substances when the yarn or fibers is/are subjected to flame;

and wherein the casing comprises at least yarn or fibers A.

The composite yarn of the invention is a yarn of bright color. By way of example, the bright color may be bright red or royal blue. The term "yarn of bright color" preferably covers yarn having a luminance factor β, as defined in standard EN 471, of not less than 0.2.

The composite yarn is preferably is a high visibility yarn, colored yellow, orange, or red. High visibility is characterized by chromaticity coordinates and by a luminance factor, in accordance with standard EN 471. The method of testing chromaticity coordinates and luminance factor are specified in CIE standard 15.2:1986.

In a preferred embodiment of the invention, the composite yarn is a high visibility yarn whose chromaticity coordinates and luminance factor are selected from:

chromaticity coordinates lying in the ellipse defined by the following (X;Y) pairs of coordinates (0.610; 0.390), (0.544; 0.376), (0.579; 0.341), (0.655; 0.344) with a luminance factor β greater than 0.40;

chromaticity coordinates lying in the ellipse defined by the following (X;Y) pairs of coordinates (0.387; 0.610), (0.356; 0.494), (0.398; 0.452), (0.460; 0.540) with a luminance factor β greater than 0.76. This yarn or these fibers is/are of a fluorescent yellow color.

chromaticity coordinates lying in the ellipse defined by the following (X;Y) pairs of coordinates (0.655; 0.344), (0.579; 0.341), (0.606; 0.314), (0.690; 0.310) with a luminance factor β greater than 0.25.

According to a preferred characteristic of the invention, the yarn or fibers A are yarn or fibers of orange, yellow, or red color, of optical properties such that a casing made solely from such yarn or fibers has chromaticity coordinates and a luminance factor selected from:

chromaticity coordinates lying in the ellipse defined by the following (X;Y) pairs of coordinates (0.610; 0.390), (0.544; 0.376), (0.579; 0.341), (0.655; 0.344) with a luminance factor β greater than 0.40. This yarn or these fibers is/are of a fluorescent orange color.

chromaticity coordinates lying in the ellipse defined by the following (X;Y) pairs of coordinates (0.387, 0.610), (0.356; 0.494), (0.398; 0452), (0.460; 0.540) with a luminance factor β greater than 0.76. This yarn or these fibers is/are of a fluorescent yellow color.

chromaticity coordinates lying in the ellipse defined by the following (X;Y) pairs of coordinates (0.655; 0.344), (0.579; 0.341), (0.606; 0.314), (0.690; 0.310) with a luminance factor β greater than 0.25. This yarn or these fibers is/are of a fluorescent red color.

The composite yarn is obtained from yarn or fibers or several types, yarn or fibers A, B, and/or C. If a yarn or fiber presents simultaneously the characteristics of yarn or fibers of two types, e.g. B and C, then it belongs to each of those two types.

Yarn or fibers A are used in making up the casing of the composite fiber so as to appear at the surface of the composite fiber of the invention.

The term "yarn" is used to cover a continuous multifilament object, continuous fiber-spun yarn obtained from a single type of fiber, or a mixture of fibers, e.g. intimately mixed fibers B and C, or fibers B and/or C with other fibers. It also covers a continuous yarn obtained by assembling a plurality of yarn or filaments, or a continuous monofilament.

By way of example, the yarn or fibers A may be yarn or fibers based on polyethylene terephthalate including a pigment that is introduced prior to spinning and that confers the required color to the yarn or fibers. The pigment is advantageously of orange color. By way of example it may comprise orange yarn sold by the supplier Trevira under the reference Texturgarn Typ 501 V.

It may also comprise yarn or fibers based on polyethylene terephthalate of color provided by a dye. By way of example, the surface treatment may comprise a step of introducing yarn or fibers into a solution containing a dye corresponding to the desired color.

The composite yarn of the invention may comprise yarn of fibers A of different kinds.

The yarn or fibers B are temperature-stable. It is this yarn or these fibers in which shrinkage and loss of mechanical properties are limited after exposure of short duration to flame (where "short" means about 3 to 4 seconds). By way of example, mention can be made of yarn or fiber based on temperature-stable polymers such as polyamide-imide, polyparaphenylene terephthalamide, polymetaphenylene, isophtalamide, polimides, polybenzimidazole (PBI), polyparaphenylene-2,6-benzobisoxazole (PBO), melamine, polyacrylate. The yarn or fibers are preferably yarn or fibers based on para-aramids. The yarn B may be constituted by a mixture of fibers, generally an intimate mixture. For example it may comprise intimate mixtures of aramid fibers and fireproofed fibers based on viscose, for example a mixture of polyamide-imide fibers and fireproofed viscose fibers, possibly with fibers of paraphenylene terephthalamide. The yarn may be also be constituted by fibers of polymetaphenylene isophthalamide, or a mixture of such fibers, in particular with fibers of paraphenylene terephthalamide.

The yarn of fibers B of the invention may be constituted by an association of yarn or fibers not having temperature-stable characteristics together with other yarn or fibers, such as smothering yarn or fibers, for example. The yarn or fibers B made by this association satisfy standard EN 531. By way of example, mention can be made of an association of cotton yarn or fibers not having temperature-stable characteristics with smothering yarn or fibers such as modacrylic fibers.

The composite yarn of the invention may comprise yarn or fibers B of different kinds.

The yarn or fibers B optionally present in the casing of the composite yarn of the invention may be dyed prior to preparing the composite yarn by using any technique known to the person skilled in the art so as to present a color matching the color of the yarn or fibers A of the casing.

The yarn or fibers C are smothering yarn or fibers that give off gases during combustion. This yarn or these fibers prevent or limit combustion of the adjacent yarn of fibers. The gas given off generally comes from the material constituting the yarn or fiber decomposing. It may also come from an additive or a finish. As examples of smothering fibers, mention can be made of modacrylic fibers and fibers made of pre-oxidized polyacrylonitrile (PPAN). It is possible to use composite yarn comprising at least two kinds of yarn twisted together, temperature-stable yarn and yarn comprising smothering fibers, on their own or in a mixture. It is also possible to use non-twisted yarn, comprising smothering fibers alone or in a mixture.

By way of example, the following fibers that give off gas can be mentioned:

spun yarn or fibers of modacrylic or PPAN fibers;

spun yarn or fibers in an intimate mixture comprising modacrylic fibers or PPAN with temperature-stable fibers selected, for example, from aramids, polybenzimidazole, PBO, phenolic resin fibers, glass fibers, carbon fibers, and melamine; and twisted yarn comprising yarn comprising temperature-stable fibers on their own or in a mixture together with one of the above-described kinds of spun yarn.

As an example of spun yarn of fibers comprising modacrylic fibers, mention can be made of Protex M or S fibers sold by the supplier Kaneka, Lufnen VF1 and VE1 fibers, and Super valzer fibers.

The yarn or fibers C preferably present an oxygen limit index greater than 30%.

The composite yarn of the invention may comprise yarn or fibers C of different kinds.

The yarn or fibers C optionally present in the casing of the composite yarn of the invention are generally dyed prior to preparing the composite yarn using any technique known to the person skilled in the art in order to present a color that matches the color of the yarn or fibers A of the casing.

The yarn or fibers A, B, and/or C of the invention define at least part of the structure and the construction of the composite yarn. The yarn or fibers A, B, and/or C may, for example, be used in association with yarn or fibers of types other than A, B, and/or C. Each yarn or fiber type A, B, and/or C of the invention may include yarn or fibers of other types.

In a preferred embodiment of the invention, the core of the composite yarn of the invention comprises at least yarn or fibers B and/or yarn or fibers C. The core of the composite yarn may be constituted, for example, by yarn spun from fibers B and fibers C in intimate mixture.

The core and/or the casing of the composite yarn of the invention may both be constituted by yarn spun from fibers of the same kind or fibers of different kinds in intimate mixture.

The casing of the composite yarn of the invention may also comprise, in addition to the yarn or fibers A, yarn or fibers B, and/or yarn or fibers C.

According to a particular characteristic of the invention, the casing of the composite yarn of the invention comprises at least yarn or fibers A and yarn or fibers C, and the core comprises at least yarn or fibers B. By way of example, the core may be constituted by yarn spun from fibers B on their own or in a mixture, e.g. in intimate mixture with other fibers.

According to another particular characteristic of the invention, the casing of the composite yarn of the invention comprises at least yarn or fibers A and yarn or fibers B, and the core comprises at least yarn or fibers C. By way of example, the core may be constituted by yarn spun from fibers C alone or in a mixture, e.g. in intimate mixture with other fibers.

The yarn or fibers A, e.g. based on polyethylene terephthalate, preferably cover more than 60% of the surface of the high visibility yarn of the invention.

Advantageously, the yarn or fibers A represent at least 20% by weight relative to the total weight of the yarn of the invention, and preferably at least 40%. In general, this proportion by weight should be less than or equal to 70%.

The proportion by weight in the composite yarn of the invention of yarn or fibers B is preferably greater than 30%. The ratio by weight of yarn or fibers C relative to yarn or fibers A, e.g. based on polyethylene terephthalate, preferably lies in the range 25/75 to 75/25.

The composite yarn of the invention may be obtained by any technique known to the person skilled in the art of "core-spinning", i.e. spinning simultaneously yarn or fibers constituting the casing and yarn or fibers constituting the core. In particular, any method may be used consisting in winding the yarn or fibers constituting the casing around the yarn or fibers constituting the core. Winding techniques include, for example, providing a covering around yarn that is continuous or that is spun from fibers, for example. This method is known to the person skilled in the art. Mention also be made of the method known by the name "Dref" as implemented on a spinning frame from the supplier Fehrer. In that method, the yarn or fibers is/are wound around the core which, as a result, is not subjected to axial twisting as happens with conventional spinning methods.

In particular, the Dref 3 method can be used for obtaining the composite yarn of the invention. That method and its operation have already been described several times in the specialist literature for textiles, and in particular in the article by H. Fuchs "Herstellung von Mehrkomponentengamen mit Hilfe des Friktionsspinverfahrens", Melliand Textilberichte, Vol. 64, 1983, pp. 618–622.

The Dref 3 method can also be used for preparing the composite yarn of the invention. This method has also been described several times in the specialist textile literature. The yarn obtained by this method is generally coarser than the yarn obtained by the Dref 3 method.

The methods described above are not limiting in any way.

The composite yarn of the invention may be used for obtaining textile articles. Such textile articles may be woven or knitted. The composite yarn of the invention defines at least part of the structure and the construction of the textile article. For example, in addition to the composite yarn of the invention, the article may also comprise yarn of a type that is different therefrom. By way of example, the textile article may comprise yarn of types A, B, or C and other types of yarn. In particular, the textile article may comprise yarn B when the composite yarn does not have any yarn or fiber B. Similarly, the article may comprise yarn or fibers C when the composite yarn does not have any yarn or fibers C, for example.

In a woven article, e.g. a woven surface, the composite yarn of the invention may be used to constitute the weft yarn and/or the warp yarn, for example.

Other details or advantages of the invention appear more clearly from the following example given without limiting effect.

DETAILED DESCRIPTION OF THE EXAMPLE

Example

Composite yarn was prepared by core spinning the spun yarn of casing fibers around the spun yarn of core fibers.

The core fiber spun yarn represented, relative to the total weight of the yarn:

30% by weight of para-aramid fibers; and

10% by weight of modacrylic fibers;

in intimate mixture.

The spun yarn of casing fibers represented:

50% by weight of polyethylene terephthalate fibers; and

10% by weight of modacrylic fibers in intimate mixture.

The yarn was subjected to the tests defined in standards EN 471 and EN 531. The yarn complied with those standards, being classified A, B1, C1 for the EN 531 standard.

The EN 471 standard for "High-Visibility Warning Clothing" is available through Comite Europeen de Normalization (CEN; Secretariat Central: rue de Stassart 36, B-1050Bruxelles; Ref. no. prEN 471:1983), and this standard includes in part, for color of base material, provides chromaticity coordinates and minimal luminance factor for three fluorescent colors in Table 2.

| | Chromaticity Coordinates | | Minimal Luminance Factor |
|---|---|---|---|
| Color | X | Y | (β min) |
| Yellow fluorescent | 0.367 | 0.610 | 0.76 |
| | 0.356 | 0.494 | |
| | 0.398 | 0.452 | |
| | 0.460 | 0.540 | |
| Orange-red fluorescent | 0.610 | 0.390 | 0.40 |
| | 0.544 | 0.376 | |
| | 0.579 | 0.341 | |
| | 0.655 | 0.344 | |
| Red fluorescent | 0.655 | 0.344 | 0.25 |
| | 0.579 | 0.341 | |
| | 0.606 | 0.314 | |
| | 0.690 | 0.310 | |

EN 471 standard "Table 2: Color of base material" (appearing on page 8, prEN 471:1993; original in French)

The CIE standard 15.2:1986 is the second edition of the CIE Recommendations on Colorimetry, available from the Commission Internationale de L Eclairage (CIE Central Bureau, Vienna, Austria). CIE 15.2 includes standards for chromaticity coordinates, luminance factor b, and various other colorimetric practices and formulae. Standard EN 471, sub-paragraph 7.2, specifies CIE procedures for determining color, as follows:

"The color must be measured conforming to the method described in publication CEI no. 15 with illumination D65 in a geometry of 45/0, and with the observer standard of 2 degrees. The sample must be on a black background of reflectance less than 0.04."

The EN 531 standard for "Protective clothing for industrial workers exposed to heat (excluding firefighters' and welders' clothing)" is available through Comite Europeen de Normalization (CEN; Secretariat Central: rue de Stassart 36, B-1050 Bruxelles; Ref. no. prEN 531:1994)

The invention claimed is:

1. A composite yarn of bright color comprising a core surrounded by a casing having an outer surface, the yarn comprising at least:

yarn or fibers A of bright color based on polyethylene terephtalate;

at least one type of yarn or fibers selected from the following group:

temperature-stable yarn or fibers B; and smothering yarn or fibers C causing gas to be given off when subjected to a flame;

wherein the outer surface of the casing comprises more than 60% by area yarn or fibers A and wherein the chromaticity coordinates and the luminance factor of the casing are selected from:

chromaticity coordinates lying in the ellipse defined by the following (X;Y) pairs of coordinates (0.610; 0.390), (0.544; 0.376), (0.579; 0.341), (0.655; 0.344) with a luminance factor β greater than 0.40;

chromaticity coordinates lying in the ellipse defined by the following (X;Y) pairs of coordinates (0.387, 0.610), (0.356; 0.494), (0.398; 0.452), (0.460; 0.540) with a luminance factor β greater than 0.76; or chromaticity coordinates lying in the ellipse defined by the following (X;Y) pairs of coordinates (0.655; 0.344), (0.579; 0.341), (0.606; 0.314), (0.690; 0.310) with a luminance factor β greater than 0.25.

2. Composite yarn according to claim 1, wherein the core comprises yarn or fibers B and yarn or fibers C.

3. Composite yarn according to claim 1, wherein the casing comprises yarn or fibers C.

4. Composite yarn according to claim 1, wherein:

the casing comprises yarn or fibers A and yarn or fibers C; and the core comprises yarn or fibers B and yarn or fibers C.

5. Composite yarn according to claim 1, wherein the yarn or fibers B is/are based on synthetic material selected from polyamide-imide, polyparaphenylene terephthalamide, polymetaphenylene isophtalamide, polybenzimidazole, polyparaphenylene-2,6-benzobisoxazole, melamine, and polyacrylate.

6. Composite yarn according to claim 1, wherein the yarn or fibers C is/are based on modacrylic or pre-oxidized polyacrylonitrile fibers.

7. Composite yarn according to claim 1, wherein the yarn or fibers A represent at least 20% by weight relative to the total weight of the yarn.

8. Composite yarn according to claim 1, the yarn being obtained by a core spinning technique of casing yarn or fibers and core yarn or fibers, e.g. a covering technique.

9. The use of composite yarn according to claim 1 to obtain textile articles.

10. Composite yarn according to claim 7, wherein the yarn or fibers A represent at least 40% by weight relative to the total weight of the yarn.

11. Composite yarn according to claim 1, wherein, relative to the total weight of the yarn, the core comprises 30% by weight of para-aramide fibers and 10% by weight of modacrylic fibers and the casing comprises 50% by weight of polyethylene teraphtalate fibers and 10% by weight of modacrylic fibers.

* * * * *

UNITED STATES PATENT AND TRADEMARK OFFICE

CERTIFICATE OF CORRECTION

PATENT NO. : 7,107,750 B2
APPLICATION NO. : 10/481843
DATED : September 19, 2006
INVENTOR(S) : Laurent Thiriot It is certified that error appears in the above-identified patent and that said Letters Patent is hereby corrected as shown below:

Column 2, lines 28-29, delete the sentence: "This yarn or these fibers is/are of a fluorescent yellow color."

Column 2, line 46, "0452" should read --0.452--; and

Column 6, Table 2, second column first number, "0.367" should read --0.387--.

Signed and Sealed this

Fourteenth Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,107,750 B2
APPLICATION NO. : 10/481843
DATED : September 19, 2006
INVENTOR(S) : Laurent Thiriot It is certified that error appears in the above-identified patent and that said Letters Patent is hereby corrected as shown below:

Column 2, lines 28-29, delete the sentence: "This yarn or these fibers is/are of a fluorescent yellow color."

Column 2, line 46, "0452" should read --0.452--; and

Column 6, Table 2, second column, first number, "0.367" should read --0.387--.

Signed and Sealed this

Twenty-eighth Day of August, 2007

JON W. DUDAS
*Director of the United States Patent and Trademark Office*